US009127870B2

(12) United States Patent
Wightman

(10) Patent No.: US 9,127,870 B2
(45) Date of Patent: Sep. 8, 2015

(54) SURGED VAPOR COMPRESSION HEAT TRANSFER SYSTEMS WITH REDUCED DEFROST REQUIREMENTS

(75) Inventor: David Wightman, Arlington Heights, IL (US)

(73) Assignee: XDX Global, LLC, Arlington Heights, IL (US)

( * ) Notice: Subject to any disclaimer, the term of this patent is extended or adjusted under 35 U.S.C. 154(b) by 259 days.

(21) Appl. No.: 12/914,362

(22) Filed: Oct. 28, 2010

(65) Prior Publication Data

US 2011/0126560 A1 Jun. 2, 2011

Related U.S. Application Data

(63) Continuation of application No. PCT/US2009/044112, filed on May 15, 2009.

(60) Provisional application No. 61/053,452, filed on May 15, 2008.

(51) Int. Cl.

| | |
|---|---|
| ***F25D 21/06*** | (2006.01) |
| ***F25D 21/00*** | (2006.01) |
| ***F25B 41/00*** | (2006.01) |
| ***F25B 47/00*** | (2006.01) |
| ***F25B 47/02*** | (2006.01) |
| *F25D 21/04* | (2006.01) |

(52) U.S. Cl.

CPC ..... *F25B 47/02* (2013.01); *F25B 2400/23* (2013.01); *F25D 21/04* (2013.01)

(58) Field of Classification Search

CPC .... F25B 47/02; F25B 47/022; F25B 2400/23; F25B 2400/24; F25B 2400/16; F25D 21/00; F25D 21/04; F25D 21/06

USPC ..... 62/151, 152, 80, 81, 272, 277, 509

See application file for complete search history.

(56) References Cited

U.S. PATENT DOCUMENTS

| | | | |
|---|---|---|---|
| 2,084,755 | A | 6/1937 | Young |
| 2,112,039 | A | 3/1938 | McLenegan |
| 2,126,364 | A | 8/1938 | Witzel |

(Continued)

FOREIGN PATENT DOCUMENTS

| | | |
|---|---|---|
| DE | 19752259 | 11/1997 |
| DE | 19743734 | 4/1999 |

(Continued)

OTHER PUBLICATIONS

International Searching Authority, "International Search Report and Written Opinion for PCT/US2009/044112", Oct. 6, 2009, Publisher: European Patent Office, Published in: EP.

*Primary Examiner* — Frantz Jules
*Assistant Examiner* — Joseph Trpisovsky
(74) *Attorney, Agent, or Firm* — Blanchard & Associates

(57) ABSTRACT

Surged vapor compression heat transfer systems, devices, and methods are disclosed having refrigerant phase separators that generate at least one surge of vapor phase refrigerant into the inlet of an evaporator after the initial cool-down of an on cycle of the compressor. This surge of vapor phase refrigerant, having a higher temperature than the liquid phase refrigerant, increases the temperature of the evaporator inlet, thus reducing frost build up in relation to conventional refrigeration systems lacking a surged input of vapor phase refrigerant to the evaporator.

50 Claims, 8 Drawing Sheets

(56) References Cited

U.S. PATENT DOCUMENTS 2,164,761 A 7/1939 Ashley
2,200,118 A 5/1940 Miller
2,229,940 A 1/1941 Spofford
2,323,408 A 7/1943 Miller
2,511,565 A 6/1950 Carter
2,520,191 A 8/1950 Aughey et al.
2,539,062 A 1/1951 Dillman
2,547,070 A 4/1951 Aughey et al.
2,581,625 A 1/1952 Brady
2,596,036 A 5/1952 MacDougall
2,707,868 A 5/1955 Goodman
2,741,448 A 4/1956 Beckwith
2,755,025 A 7/1956 Boles
2,771,092 A 11/1956 Schenk
2,856,759 A 10/1958 Barbulesco
2,922,292 A 1/1960 Lange
2,944,411 A 7/1960 McGrath
3,014,351 A 12/1961 Leimbach
3,060,699 A 10/1962 Tilney
3,138,007 A 6/1964 Friedman et al.
3,150,498 A 9/1964 Blake
3,194,499 A 7/1965 Noakes et al.
3,316,731 A 5/1967 Quick
3,343,375 A 9/1967 Quick
3,402,566 A 9/1968 Leimbach
3,427,819 A 2/1969 Seghetti
3,443,793 A 5/1969 Hulsey
3,464,226 A 9/1969 Kramer
3,520,147 A 7/1970 Glackman
3,631,686 A 1/1972 Kautz
3,633,378 A 1/1972 Toth
3,638,444 A 2/1972 Lindahl
3,638,447 A 2/1972 Abe
3,677,336 A 7/1972 Moore, Jr.
3,683,637 A 8/1972 Oshima et al.
3,708,998 A 1/1973 Scherer et al.
3,727,423 A 4/1973 Nielson
3,734,173 A 5/1973 Moritz
3,741,242 A 6/1973 Hansen et al.
3,741,289 A 6/1973 Moore
3,756,903 A 9/1973 Jones
3,785,163 A 1/1974 Wagner
3,792,594 A 2/1974 Kramer
3,798,920 A 3/1974 Morgan
3,822,562 A 7/1974 Crosby
3,866,427 A 2/1975 Rothmayer et al.
3,921,413 A 11/1975 Kohlbeck
3,934,424 A 1/1976 Goldsberry
3,934,426 A 1/1976 Jespersen et al.
3,948,060 A 4/1976 Gaspard
3,965,693 A 6/1976 Widdowson
3,967,466 A 7/1976 Edwards
3,967,782 A 7/1976 Eschbaugh et al.
3,968,660 A 7/1976 Amann et al.
3,980,129 A 9/1976 Bergdahl
4,003,729 A 1/1977 McGrath
4,003,798 A 1/1977 McCord
4,006,601 A 2/1977 Ballarin et al.
4,023,377 A * 5/1977 Tomita ..... 62/196.4
4,103,508 A 8/1978 Apple
4,106,691 A 8/1978 Nielsen
4,122,686 A 10/1978 Lindahl et al.
4,122,688 A 10/1978 Mochizuki
4,136,528 A 1/1979 Vogel et al.
4,151,722 A 5/1979 Willitts et al.
4,163,373 A 8/1979 Van der Sluijs
4,167,102 A * 9/1979 Willitts ..... 62/152
4,176,525 A 12/1979 Tucker et al.
4,182,133 A 1/1980 Haas et al.
4,184,341 A 1/1980 Friedman
4,193,270 A 3/1980 Scott
4,207,749 A 6/1980 Lavigne, Jr.
4,230,470 A 10/1980 Matsuda
4,235,079 A 11/1980 Masser
4,270,362 A 6/1981 Lancia et al.
4,285,205 A 8/1981 Martin
4,290,480 A 9/1981 Sulkowski
4,302,945 A 12/1981 Bell
4,328,682 A 5/1982 Vana
4,350,021 A 9/1982 Lundstrom
4,398,396 A 8/1983 Schmerzler
4,430,866 A 2/1984 Willitts
4,451,273 A 5/1984 Cheng et al.
4,485,642 A 12/1984 Karns
4,493,193 A 1/1985 Fisher
4,493,364 A 1/1985 Macriss et al.
4,543,802 A 10/1985 Ingelmann et al.
4,583,582 A 4/1986 Grossman
4,596,123 A 6/1986 Cooperman
4,606,198 A 8/1986 Latshaw et al.
4,612,783 A 9/1986 Mertz
4,621,505 A * 11/1986 Ares et al. ..... 62/509
4,633,681 A 1/1987 Webber
4,658,596 A 4/1987 Kuwahara
4,660,385 A * 4/1987 Macriss et al. ..... 62/57
4,742,694 A 5/1988 Yamanaka et al.
4,745,767 A 5/1988 Ohya et al.
4,779,425 A 10/1988 Sasaki et al.
4,813,474 A 3/1989 Umezu
4,848,100 A 7/1989 Barthel et al.
4,852,364 A 8/1989 Seener et al.
4,854,130 A 8/1989 Naruse et al.
4,888,957 A 12/1989 Chmielewski
4,938,032 A 7/1990 Mudford
4,942,740 A 7/1990 Shaw et al.
4,947,655 A 8/1990 Shaw
4,955,205 A 9/1990 Wilkinson
4,955,207 A 9/1990 Mink
4,979,372 A 12/1990 Tanaka
4,982,572 A 1/1991 Moore
4,984,433 A 1/1991 Worthington
5,050,393 A 9/1991 Bryant
5,058,388 A 10/1991 Shaw et al.
5,062,276 A 11/1991 Dudley
5,065,591 A 11/1991 Shaw
5,070,707 A 12/1991 Ni
5,072,597 A 12/1991 Bromley et al.
5,076,068 A 12/1991 Mikhail
5,094,598 A 3/1992 Amata et al.
5,107,906 A 4/1992 Swenson et al.
5,129,234 A 7/1992 Alford
5,131,237 A 7/1992 Valbjorn
5,168,715 A 12/1992 Nakao et al.
5,181,552 A 1/1993 Eiermann
5,195,331 A 3/1993 Zimmern et al.
5,231,845 A 8/1993 Sumitani et al.
5,249,433 A 10/1993 Hardison et al.
5,251,459 A 10/1993 Grass et al.
5,253,482 A 10/1993 Murway
5,291,941 A 3/1994 Enomoto et al.
5,303,561 A 4/1994 Bahel et al.
5,305,610 A 4/1994 Bennett et al.
5,309,725 A 5/1994 Cayce
5,329,781 A 7/1994 Farrey et al.
5,355,323 A 10/1994 Bae
5,377,498 A 1/1995 Cur et al.
5,381,665 A * 1/1995 Tanaka ..... 62/197
5,408,835 A 4/1995 Anderson
5,423,480 A 6/1995 Heffner et al.
5,440,894 A 8/1995 Schaeffer et al.
5,509,272 A 4/1996 Hyde
5,515,695 A 5/1996 Sakakibara et al.
5,520,004 A 5/1996 Jones, III
5,544,809 A 8/1996 Keating et al.
5,586,441 A 12/1996 Wilson et al.
5,597,117 A 1/1997 Watanabe et al.
5,598,715 A 2/1997 Edmisten
5,615,560 A 4/1997 Inoue
5,622,055 A 4/1997 Mei et al.
5,622,057 A 4/1997 Bussjager et al.
5,634,355 A 6/1997 Cheng et al.
5,651,258 A 7/1997 Harris
5,678,417 A 10/1997 Nigo et al.
5,689,962 A 11/1997 Rafalovich

(56) References Cited

U.S. PATENT DOCUMENTS

| | | | |
|---|---|---|---|
| 5,692,387 | A | 12/1997 | Alsenz et al. |
| 5,694,782 | A | 12/1997 | Alsenz |
| 5,706,665 | A | 1/1998 | Gregory |
| 5,706,666 | A | 1/1998 | Yamanaka et al. |
| 5,743,100 | A | 4/1998 | Welguisz et al. |
| 5,752,390 | A | 5/1998 | Hyde |
| 5,765,391 | A | 6/1998 | Lee et al. |
| 5,806,321 | A | 9/1998 | Bendtsen et al. |
| 5,813,242 | A | 9/1998 | Lawrence et al. |
| 5,826,438 | A | 10/1998 | Ohishi et al. |
| 5,839,505 | A | 11/1998 | Ludwig et al. |
| 5,842,352 | A | 12/1998 | Gregory |
| 5,845,511 | A | 12/1998 | Okada et al. |
| 5,850,968 | A | 12/1998 | Jokinen |
| 5,862,676 | A | 1/1999 | Kim et al. |
| 5,867,998 | A | 2/1999 | Guertin |
| 5,964,099 | A | 10/1999 | Kim |
| 6,105,379 | A | 8/2000 | Alsenz et al. |
| 6,158,466 | A | 12/2000 | Riefler |
| 6,185,958 | B1 | 2/2001 | Wightman |
| 6,230,506 | B1 | 5/2001 | Nishida et al. |
| 6,237,351 | B1 | 5/2001 | Itoh et al. |
| 6,301,912 | B1 | 10/2001 | Terai et al. |
| 6,314,747 | B1 | 11/2001 | Wightman |
| 6,318,118 | B2 | 11/2001 | Hanson et al. |
| 6,357,246 | B1 | 3/2002 | Jin |
| 6,367,279 | B1 | 4/2002 | Jin |
| 6,389,825 | B1 | 5/2002 | Wightman |
| 6,393,851 | B1 | 5/2002 | Wightman |
| 6,397,629 | B2 | 6/2002 | Wightman |
| 6,398,825 | B1 | 6/2002 | Siniakevith et al. |
| 6,398,829 | B1 | 6/2002 | Shinler et al. |
| 6,401,470 | B1 | 6/2002 | Wightman |
| 6,401,471 | B1 | 6/2002 | Wightman |
| 6,418,745 | B1 | 7/2002 | Ratliff |
| 6,581,398 | B2 | 6/2003 | Wightman |
| 6,644,052 | B1 | 11/2003 | Wightman |
| 6,668,569 | B1 | 12/2003 | Jin |
| 6,679,321 | B2 | 1/2004 | Jin |
| 6,739,139 | B1 | 5/2004 | Solomon |
| 6,751,970 | B2 | 6/2004 | Wightman |
| 6,857,281 | B2 | 2/2005 | Wightman |
| 6,862,892 | B1 | 3/2005 | Meyer et al. |
| 6,915,648 | B2 | 7/2005 | Wightman |
| 6,915,656 | B2 | 7/2005 | Ratliff |
| 6,951,117 | B1 | 10/2005 | Wightman |
| 7,003,964 | B2 | 2/2006 | Solomon |
| 7,191,604 | B1 | 3/2007 | Wiggs |
| 7,207,188 | B2 | 4/2007 | Solomon |
| RE39,625 | E | 5/2007 | Shaw |
| 7,222,496 | B2 | 5/2007 | Choi et al. |
| 7,225,627 | B2 | 6/2007 | Wightman |
| 7,448,229 | B2 | 11/2008 | Chin et al. |
| 7,464,562 | B2 | 12/2008 | Inoue et al. |
| 7,523,623 | B2 | 4/2009 | Taras et al. |
| 7,543,456 | B2 | 6/2009 | Sinha |
| 7,578,140 | B1 | 8/2009 | Wiggs |
| 7,591,145 | B1 | 9/2009 | Wiggs |
| 7,603,872 | B2 | 10/2009 | Tanaami et al. |
| 7,607,314 | B2 | 10/2009 | Eisenhour |
| 7,628,021 | B2 | 12/2009 | McPherson |
| 7,654,104 | B2 | 2/2010 | Groll et al. |
| 7,658,072 | B2 | 2/2010 | Masada |
| 7,658,082 | B2 | 2/2010 | Jagusztyn |
| 7,661,464 | B2 | 2/2010 | Khrustalev et al. |
| 7,661,467 | B1 | 2/2010 | Matthys et al. |
| 7,663,388 | B2 | 2/2010 | Barabi et al. |
| 7,669,430 | B2 | 3/2010 | Matsui et al. |
| 2003/0140644 | A1* | 7/2003 | Wightman ..... 62/196.4 |
| 2005/0257564 | A1* | 11/2005 | Wightman ..... 62/510 |
| 2008/0092569 | A1 | 4/2008 | Doberstein et al. |

FOREIGN PATENT DOCUMENTS

| | | |
|---|---|---|
| EP | 0355180 | 8/1988 |
| GB | 1580997 | 12/1980 |
| JP | 58146778 | 9/1983 |
| JP | 03020577 | 1/1991 |
| JP | 7103622 | 4/1995 |
| JP | 10325630 | 12/1997 |
| JP | 10306958 | 11/1998 |
| JP | 2002031459 | 1/2002 |
| WO | 9306422 | 4/1993 |
| WO | 9503515 | 2/1995 |
| WO | 9803827 | 1/1998 |
| WO | 9857104 | 12/1998 |

* cited by examiner

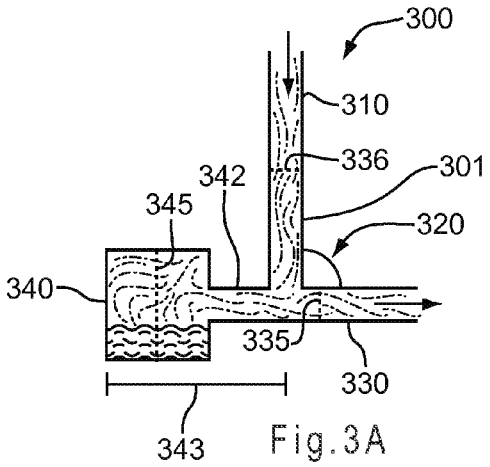
Fig.3A
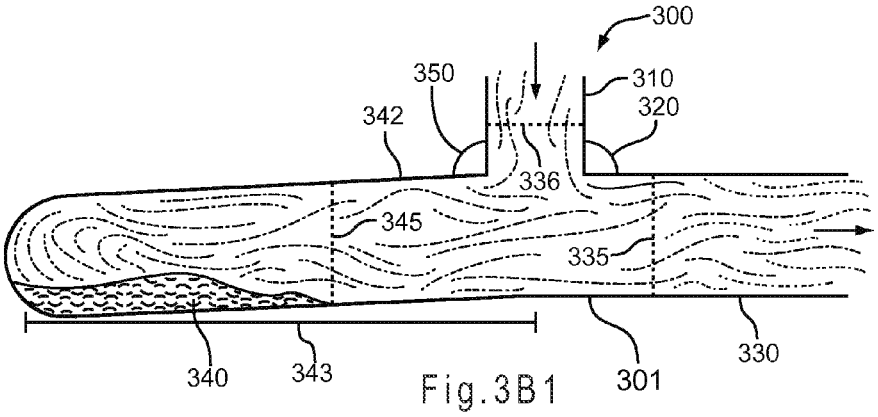
Fig.3B1
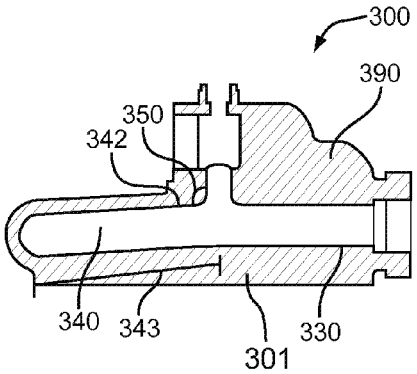
Fig.3B2

Two Refrigeration Cycles Duration: 9:35 through 10:04

A------- Comp suction Psi B——— Ambient Air Temperature Supply C——— inlet finsurface D——— Evap tube inlet E- - - - Dewpoint temp

SURGED VAPOR COMPRESSION HEAT TRANSFER SYSTEMS WITH REDUCED DEFROST REQUIREMENTS

REFERENCE TO RELATED APPLICATIONS

This application is a continuation of PCT/US09/44112 entitled "Surged Vapor Compression Heat Transfer System With Reduced Defrost" filed May 15, 2009, which was published in English and claimed the benefit of U.S. Provisional Application No. 61/053,452 entitled "Surged Vapor Compression Heat Transfer Systems, Devices, and Methods for Reducing Defrost Requirements" filed May 5, 2008, which are incorporated by reference in their entirety.

BACKGROUND

Vapor compression systems circulate refrigerant in a closed loop system to transfer heat from one external medium to another external medium. Vapor compression systems are used in air-conditioning, heat pump, and refrigeration systems. FIG. 1 depicts a conventional vapor compression heat transfer system 100 that operates though the compression and expansion of a refrigerant fluid. The vapor compression system 100 transfers heat from a first external medium 150, through a closed-loop, to a second external medium 160. Fluids include liquid and/or gas phases.

A compressor 110 or other compression device reduces the volume of the refrigerant, thus creating a pressure difference that circulates the refrigerant through the loop. The compressor 110 may reduce the volume of the refrigerant mechanically or thermally. The compressed refrigerant is then passed through a condenser 120 or heat exchanger, which increases the surface area between the refrigerant and the second external medium 160. As heat transfers to the second external medium 160 from the refrigerant, the refrigerant contracts in volume.

When heat transfers to the compressed refrigerant from the first external medium 150, the compressed refrigerant expands in volume. This expansion is often facilitated with a metering device 130 including an expansion device and a heat exchanger or evaporator 140. The evaporator 140 increases the surface area between the refrigerant and the first external medium 150, thus increasing the heat transfer between the refrigerant and the first external medium 150. The transfer of heat into the refrigerant causes at least a portion of the expanded refrigerant to undergo a phase change from liquid to gas. The heated refrigerant is then passed back to the compressor 110 and the condenser 120, where at least a portion of the heated refrigerant undergoes a phase change from gas to liquid when heat transfers to the second external medium 160.

The closed-loop heat transfer system 100 may include other components, such as a compressor discharge line 115 joining the compressor 110 and the condenser 120. The outlet of the condenser 120 may be coupled to a condenser discharge line 125, and may connect to receivers for the storage of fluctuating levels of liquid, filters and/or desiccants for the removal of contaminants, and the like (not shown). The condenser discharge line 125 may circulate the refrigerant to one or more metering devices 130.

The metering device 130 may include one or more expansion devices. An expansion device may be any device capable of expanding, or metering a pressure drop in the refrigerant at a rate compatible with the desired operation of the system 100. Useful expansion devices include thermal expansion valves, capillary tubes, fixed and adjustable nozzles, fixed and adjustable orifices, electronic expansion valves, automatic expansion valves, manual expansion valves, and the like. The expanded refrigerant enters the evaporator 140 in a substantially liquid state with a small vapor fraction.

The refrigerant exiting the expansion portion of the metering device 130 passes through an expanded refrigerant transfer system 135, which may include one or more refrigerant directors 136, before passing to the evaporator 140. The expanded refrigerant transfer system 135 may be incorporated with the metering device 130, such as when the metering device 130 is located close to or integrated with the evaporator 140. Thus, the expansion portion of the metering device 130 may be connected to one or more evaporators by the expanded refrigerant transfer system 135, which may be a single tube or include multiple components. The metering device 130 and the expanded refrigerant transfer system 135 may have fewer or additional components, such as described in U.S. Pat. Nos. 6,751,970 and 6,857,281, for example.

One or more refrigerant directors may be incorporated with the metering device 130, the expanded refrigerant transfer system 135, and/or the evaporator 140. Thus, the functions of the metering device 130 may be split between one or more expansion device and one or more refrigerant directors and may be present separate from or integrated with the expanded refrigerant transfer system 135 and/or the evaporator 140. Useful refrigerant directors include tubes, nozzles, fixed and adjustable orifices, distributors, a series of distributor tubes, valves, and the like.

The evaporator 140 receives the expanded refrigerant and provides for the transfer of heat to the expanded refrigerant from the first external medium 150 residing outside of the closed-loop heat transfer system 100. Thus, the evaporator or heat exchanger 140 facilitates in the movement of heat from one source, such as ambient temperature air, to a second source, such as the expanded refrigerant. Suitable heat exchangers may take many forms, including copper tubing, plate and frame, shell and tube, cold wall, and the like. Conventional systems are designed, at least theoretically, to completely convert the liquid portion of the refrigerant to vaporized refrigerant from heat transfer within the evaporator 140. In addition to the heat transfer converting liquid refrigerant to a vapor phase, the vaporized refrigerant may become superheated, thus having a temperature in excess of the boiling temperature and/or increasing the pressure of the refrigerant. The refrigerant exits the evaporator 140 through an evaporator discharge line 145 and returns to the compressor 110.

In conventional vapor compression systems, the expanded refrigerant enters the evaporator 140 at a temperature that is significantly colder than the temperature of the air surrounding the evaporator. As heat transfers to the refrigerant from the evaporator 140, the refrigerant temperature increases in the later or downstream portion of the evaporator 140 to a temperature above that of the air surrounding the evaporator 140. This rather significant temperature difference between the initial or inlet portion of the evaporator 140 and the later or outlet portion of the evaporator 140 may lead to oiling and frosting problems at the inlet portion.

A significant temperature gradient between the inlet portion of the evaporator 140 and the outlet portion of the evaporator 140 may lead to lubricating oil, which is intended to be carried by the refrigerant, separating from the refrigerant, and "puddling" in the inlet portion of the evaporator. Oil-coated portions of the evaporator 140 substantially reduce the heat transfer capacity and result in reduced heat transfer efficiency.

If the expanded refrigerant entering the evaporator 140 cools the initial portion of the evaporator 140 to below 0° C., frost may form if there is moisture in the surrounding air. To obtain maximum evaporator performance from these systems, the spacing between the fins of the evaporator 140 is narrow. However, any frost that forms on these narrow fins quickly blocks airflow through the evaporator 140, thus, reducing heat transfer to the second external medium 160 and rapidly reducing operating efficiency. Conventional heat transfer systems may be designed where the temperature of the evaporator should never drop below 0° C. In systems of this type, the average temperature of the evaporator 140 during operation of the compressor 110 ranges from about 4° to about 8° C., so that the refrigerant in the initial portion of the evaporator 140 is maintained above 0° C. However, if conditions change, such as a drop in the temperature of the air surrounding the evaporator 140, the initial portion of the evaporator 140 may drop below 0° C. and frost.

To guard against such frosting, these systems may be equipped to shutdown if the air surrounding the evaporator 140 drops below a specific temperature. Thus, the system may passively defrost by turning off the compressor 110 so that heat transfers from the first external medium 150 into the evaporator 140. Lacking the ability to actively remove the frost from the evaporator 140 through the transfer of heat from an external source, such as with an electric heating element, or by passing previously heated refrigerant, such as taken from the high pressure side of the system, through the evaporator 140 during operation, the system 100 typically shuts down to prevent failure. Active defrosting does not include time periods when the compressor 110 is not operating, unless heat is being supplied to the evaporator 140 by a source other than the refrigerant, compressor 110, or condenser 120 when the compressor 110 is not operating.

Although air conditioning system evaporators typically operate at temperatures higher than 0° C., the temperature of an air conditioning evaporator may drop below 0° C. if the temperature of the air passing through the evaporator decreases. Furthermore, as the temperature required for food storage has decreased from about 7.2° C. to 5° C., the need to operate evaporators at 0° C. and lower has increased. However, when conventional air conditioning evaporator temperatures unexpectedly drop to 0° C. or below or when conventional heat transfer systems are equipped with evaporators intended to operate at or below 0° C. for refrigeration, the conventional systems generally have expanded refrigerant in the initial portion of the evaporator 140 at a temperature below the dew point of the ambient air, resulting in moisture condensation and freezing on the evaporator during operation. As this frost encloses a portion of the evaporator's surface, thus isolating the frosted surface from direct contact with the ambient air. Consequently, airflow over and/or through the evaporator 140 is reduced and cooling efficiency decreases. As the frost built up during on-cycles of the compressor 110 may not substantially melt during off-cycles of the compressor 110, defrost cycles are used to remove the frost and restore efficiency to the system 100 when operated at or below 0° C.

Conventional heat transfer systems may passively defrost by turning off the compressor 110 or may actively defrost by applying heat to the evaporator 140 during defrost cycles. As the compressor 110 is off during passive defrosting, the rate at which the system 100 can cool is reduced. For active defrosting, the required heat may be provided to the evaporator 140 by any means compatible with the operation of the system 100, including electric heating elements, heated gasses, heated liquids, infrared irradiation, and the like. Both passive and active defrosting systems require a larger vapor compression system than would be required if the system did not have to suspend cooling to defrost. Furthermore, active methods require energy to introduce heat to the evaporator 140, and additional energy to remove the introduced heat with the compressor 110 and the condenser 120 during the next cooling cycle. Thus, active defrosting reduces the overall efficiency of the system 100 because it must heat to defrost and then re-cool to operate.

In addition to the disadvantages of increased size and reduced cooling rate or efficiency attributable to the defrost requirements of conventional heat transfer systems, conventional systems also lose efficiency due to the lower levels of relative humidity achieved during operation. As moisture forms on a surface that is colder than the dew point of the surrounding air, frost will build up on a surface that is consistently colder than the dew point of the surrounding air and below 0° C. if the velocity of the air is sufficiently low. Thus, conventional heat transfer systems consume energy to remove moisture from the surrounding air and to lower the dew point of the air surrounding the evaporator. Cooling efficiency is reduced as energy consumed condensing moisture from the air is not spent cooling the air. As with the energy consumed to actively defrost and then re-cool the evaporator 140 for cooling duty, energy consumed removing water from the air is wasted. Additionally, active defrost cycles warm the cooled air at the evaporator, and with warming, the relative humidity of the air drops.

In addition to the energy consumed, a disadvantage of dehumidification is that any moisture-containing product present in the dehumidified air, such as the food in a refrigerator, loses moisture as the system 100 continually dehumidifies the air surrounding the food. The loss of moisture may cause freezer burn, result in a weight-loss, reduce nutrients, and cause adverse changes in appearance, such as color and texture, thus decreasing the marketability of the food with time. Furthermore, weight-loss results in the loss of value for foods sold by weight.

Accordingly, there is an ongoing need for heat transfer systems having an enhanced resistance to evaporator frosting during an on cycle of the compressor. The disclosed systems, methods, and devices overcome at least one of the disadvantages associated with conventional heat transfer systems.

SUMMARY

A heat transfer system has a phase separator that provides one or more surges of a vapor phase of a refrigerant into an evaporator. The surges of the vapor phase have a higher temperature than the liquid phase of the refrigerant, and thus heat the evaporator to remove frost.

In a method of operating a heat transfer system, a refrigerant is compressed and expanded. The liquid and vapor phases of the refrigerant are at least partially separated. One or more surges of the vapor phase of the refrigerant are introduced into an initial portion of an evaporator. The liquid phase of the refrigerant is introduced into the evaporator. The initial portion of the evaporator is heated in response to the surges of the vapor phase of the refrigerant.

In a method of defrosting an evaporator in a heat transfer system, the liquid and vapor phases of a refrigerant are at least partially separated. One or more surges of the vapor phase of the refrigerant are introduced into an initial portion of an evaporator. The liquid phase of the refrigerant is introduced into the evaporator. The initial portion of the evaporator is heated in response to the at least one surge of the vapor phase of the refrigerant. Frost is removed from the evaporator.

A vapor surge phase separator may have a body portion that defines a separator inlet, a separator outlet, and a separator refrigerant storage chamber. The refrigerant storage chamber provides fluid communication between the separator inlet and the separator outlet. The separator inlet and the separator outlet are between about 40 and about 110 degrees apart. The separator refrigerant storage chamber has a longitudinal dimension. A ratio of the separator inlet to the separator outlet diameter is about 1:1.4 to 4.3 or about 1:1.4 to 2.1. A ratio of the separator inlet diameter to the longitudinal dimension is about 1:7 to 13.

A heat transfer system includes a compressor having an inlet and an outlet, a condenser having an inlet and an outlet, and an evaporator having an inlet, an initial portion, a later portion, and an outlet. The outlet of the compressor is in fluid communication with the inlet of the condenser, the outlet of the condenser is in fluid communication with the inlet of the evaporator, and the outlet of the evaporator is in fluid communication with the inlet of the compressor. A metering device in fluid communication with the condenser and the evaporator expands a refrigerant to have vapor and liquid portions. A phase separator in fluid communication with the metering device and the evaporator separates a portion of the vapor from the expanded refrigerant and provides this vapor in the form of at least one vapor surge to the initial portion of the evaporator.

Other systems, methods, features and advantages of the invention will be, or will become, apparent to one with skill in the art upon examination of the following figures and detailed description. It is intended that all such additional systems, methods, features, and advantages be included within this description, be within the scope of the invention, and be protected by the claims that follow.

BRIEF DESCRIPTION OF THE DRAWINGS

The invention may be better understood with reference to the following drawings and description. The components in the figures are not necessarily to scale, emphasis instead being placed upon illustrating the principles of the invention.

FIG. 3A depicts a side view of a phase separator.

FIG. 3B1 depicts a side view of another phase separator.

FIG. 3B2 depicts a side view of an additional phase separator.

DETAILED DESCRIPTION

Surged vapor compression heat transfer systems include refrigerant phase separators that generate at least one surge of vapor phase refrigerant into the inlet of an evaporator. The surges are generated by operating the phase separator at a refrigerant mass flow rate that is responsive to the design and dimensions of the phase separator and the heat transfer capacity of the refrigerant. The one or more surges may be generated after the initial cool-down of an on-cycle of the compressor.

The surges of vapor phase refrigerant may have a higher temperature than the liquid phase refrigerant. The surges may increase the temperature of the initial or inlet portion of the evaporator, thus reducing frost build-up in relation to conventional refrigeration systems lacking a surged input of vapor phase refrigerant to the evaporator. During a surge, the temperature of the initial portion of the evaporator may rise to within at most about 1° C. of ambient temperature. Furthermore, during the surge, the initial portion of the evaporator may become warmer than the dew point of the ambient air surrounding the evaporator. Also during the surge, the refrigerant in the initial portion of the evaporator may be at least 0.5° C. warmer, or may be at least 2° C. warmer, than the dew point of the air at the evaporator.

Figure 1:
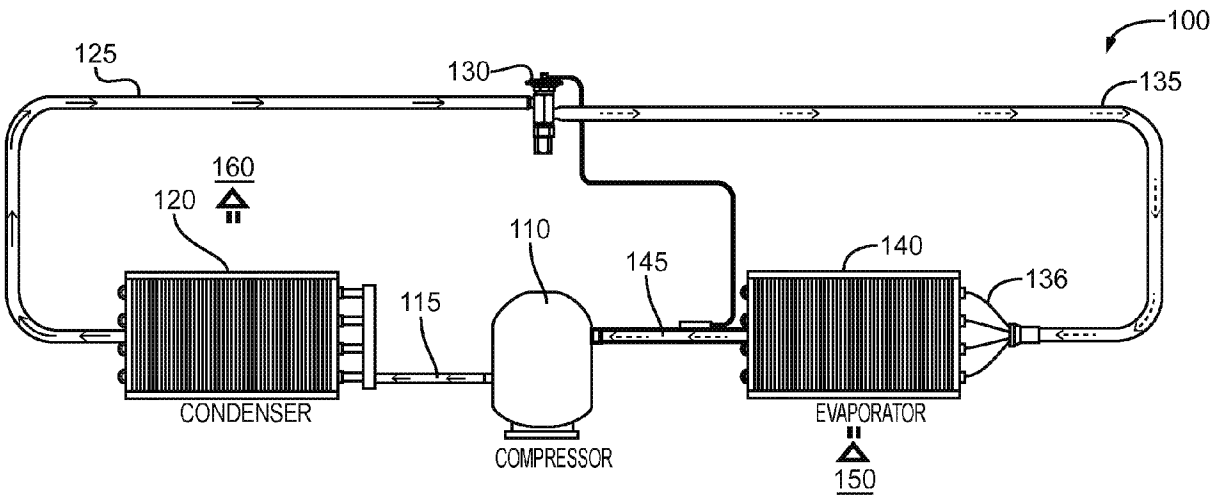
FIG. 1 depicts a schematic diagram of a conventional vapor compression heat transfer system according to the prior art.
Figure 2:
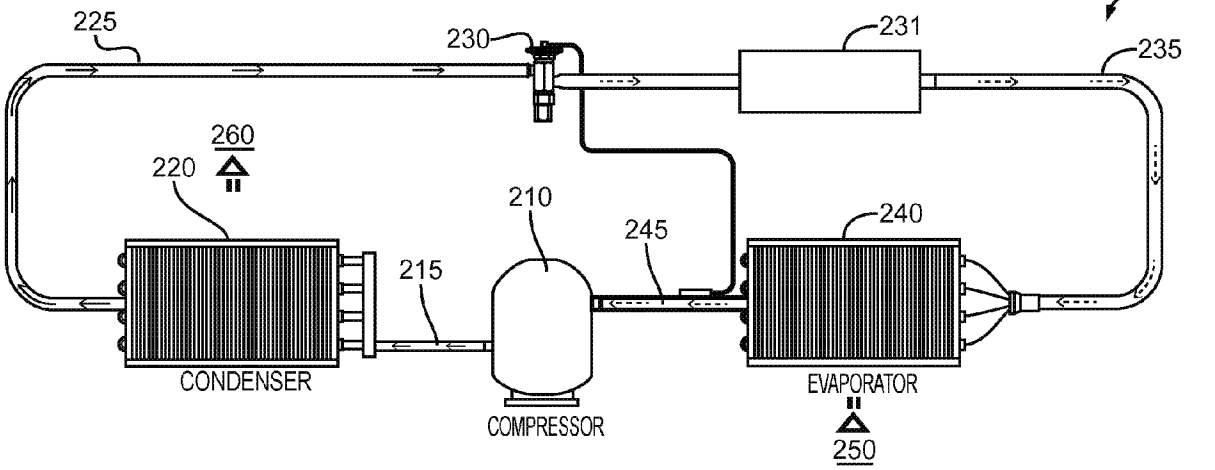
FIG. 2 depicts a schematic diagram of a surged vapor compression system.

In FIG. 2, a phase separator 231 is integrated into the conventional vapor compression heat transfer system of FIG. 1 to provide a surged vapor compression heat transfer system 200. The system 200 includes a compressor 210, a condenser 220, a metering device 230, and an evaporator 240. A compressor discharge line 215 may join the compressor 210 and the condenser 220. The outlet of the condenser 220 may be coupled to a condenser discharge line 225, and may connect to other components, such as receivers for the storage of fluctuating levels of liquid, filters and/or desiccants for the removal of contaminants, and the like (not shown). The condenser discharge line 225 may circulate the refrigerant to one or more metering devices 230. The refrigerant may then flow to the phase separator 231 and then to the evaporator 240, where an evaporator discharge line 245 returns the refrigerant to the compressor 210. The surged vapor compression system 200 may have fewer or additional components.

The phase separator 231 may be integrated with or separate from the metering device 230. The phase separator 231 may be integrated after the expansion portion of the metering device 230 and upstream of the evaporator 240. The phase separator 231 may be integrated with the metering device 230 in any way compatible with the desired operating parameters of the system. The phase separator 231 may be positioned upstream of a fixed or adjustable nozzle, a refrigerant distributor, one or more refrigerant distributor feed lines, one or more valves, and the inlet to the evaporator 240. The metering device 230 and the phase separator 231 may have fewer or additional components.

The phase separator 231 provides for at least partial separation of the liquid and vapor of the expanded refrigerant from the metering device 230 before the refrigerant enters the evaporator 240. In addition to the design and dimensions of the phase separator 231, the separation of the liquid and vapor phases may be affected by other factors, including the operating parameters of the compressor 210, the metering device 230, the expanded refrigerant transfer system 235, additional pumps, flow enhancers, flow restrictors, and the like.

During separation of the expanded refrigerant, a net cooling of the liquid and a net heating of the vapor occurs. Thus, in relation to the original temperature of the expanded refrigerant supplied to the phase separator 231, the liquid resulting from the phase separator 231 will be cooler and the vapor resulting from the phase separator will be hotter than the original temperature of the expanded refrigerant. Thus, the temperature of the vapor is raised with heat from the liquid by the phase separation, not by the introduction of energy from another source.

By operating the phase separator 231 to introduce surges of refrigerant into the evaporator 240 that are substantially vapor between operating periods of introducing refrigerant into the evaporator 240 that include a substantially increased liquid component in relation to the vapor surges, the surged vapor compression heat transfer system 200 is provided. The surged system 200 achieves a vapor surge frequency during operation of the compressor 210 that is preferred for a specific heat transfer application based on the design and dimensions of the phase separator 231 and the rate at which refrigerant is provided to the phase separator 231. The substantially vapor surges of refrigerant provided to the initial portion of the evaporator may be at least 50% vapor (mass vapor refrigerant/mass liquid refrigerant). The surged system 200 also may be operated to provide vapor surges of refrigerant that are at least 75% or at least 90% vapor to the initial portion of the evaporator.

The vapor surges transferred into the initial portion of the evaporator 240 from the phase separator 231 may reduce the tendency of lubricating oil to puddle in the initial portion of the evaporator 240. While not wishing to be bound by any particular theory, the turbulence created by the vapor surges is believed to force the oil back into the refrigerant flowing through the system, thus allowing removal from the initial portion of the evaporator 240.

By at least partially separating the liquid and vapor of the expanded refrigerant before introduction to the inlet of the evaporator 240 and surging substantially vapor refrigerant into the evaporator 240, the surged system 200 creates temperature fluctuations in the initial portion of the evaporator 240. The initial or inlet portion of the evaporator 240 may be the initial 30% of the evaporator volume nearest the inlet. The initial or inlet portion of the evaporator 240 may be the initial 20% of the evaporator volume nearest the inlet. Other inlet portions of the evaporator 240 may be used. The initial or inlet portion of the evaporator 240 that experiences the temperature fluctuations may be at most about 10% of the evaporator volume. The surged system 200 may be operated to prevent or essentially eliminate temperature fluctuations in the evaporator 240 responsive to vapor surges after the initial or inlet portion of the evaporator 240. Without the cooling capacity of the liquid, the vapor surges result in a positive fluctuation in the temperature of the initial portion of the evaporator 240.

The surged system 200 also may be operated to provide an average heat transfer coefficient from about 1.9 $Kcal_{th}$ $h^{-1}$ $m^{-2}$° $C.^{-1}$ to about 4.4 $Kcal_{th}$ $h^{-1}$ $m^{-2}$° $C.^{-1}$ from the initial portion to the outlet portion of the evaporator 240. The average heat transfer coefficient is determined by measuring the heat transfer coefficient at a minimum of 5 points from the beginning to the end of the evaporator coil and averaging the resulting coefficients. This heat transfer performance of the surged system 200 is a substantial improvement in relation to conventional non-surged systems where the initial portion of the evaporator has a heat transfer coefficient below about 1.9 $Kcal_{th}$ $h^{-1}$ $m^{-2}$° $C.^{-1}$ at the initial portion of the evaporator coil and a heat transfer coefficient below about 0.5 $Kcal_{th}$ $h^{-1}$ $m^{-2}$° $C.^{-1}$ at the portion of the evaporator before the outlet.

In addition to raising the average temperature of the initial portion of the evaporator 240 while the compressor 210 is operating in relation to a conventional system, the initial portion of the evaporator 240 of the surged system 200 experiences intermittent peak temperatures responsive to the vapor surges that may nearly equal or be higher than the external medium, such as ambient air, surrounding the evaporator 240. The intermittent peak temperatures reached by the initial portion of the evaporator 240 may be within at most about 5° C. of the temperature of the external medium. The intermittent peak temperatures reached by the initial portion of the evaporator 240 may be within at most about 2.5° C. of the temperature of the external medium. Other intermittent peak temperatures may be reached. When the external medium surrounding the evaporator 240 is air, these intermittent peak temperatures may be warmer than the dew point of the air.

The intermittent peak temperatures experienced by the initial portion of the evaporator 240 reduce the tendency of this portion of the evaporator 240 to frost. The intermittent peak temperatures also may provide for at least a portion of any frost that does form on the initial portion of the evaporator 240 during operation of the compressor 210 to melt or sublimate, thus being removed from the evaporator 240.

As the intermittent increases in temperature from the vapor surges substantially affect the initial portion of the evaporator 240, which is most likely to frost, the average operating temperature throughout the evaporator 240 may be reduced in relation to a conventional system, without increasing the propensity of the initial portion of the evaporator 240 to frost. Thus, the surged system 200 may reduce the need for defrosting, whether provided by longer periods of the compressor 210 not operating or by active methods of introducing heat to the evaporator 240 in relation to a conventional system, while also allowing for increased cooling efficiency from a lower average temperature throughout the evaporator 240.

In addition to the benefit of intermittent temperature increases at the initial portion of the evaporator 240, the ability of the phase separator 231 to at least partially separate the vapor and liquid of the refrigerant before introduction to the evaporator 240 provides additional advantages. For example, the surged system 200 may experience higher pressures within the evaporator 240 when the compressor 210 is operating in relation to conventional vapor compression systems that do not at least partially separate the vapor and liquid portions of the refrigerant before introduction to the evaporator 240. These higher pressures within the evaporator 240 may provide enhanced heat transfer efficiency to the surged system 200, as a larger volume of refrigerant may be in the evaporator 240 than would be present in a conventional system. This increase in evaporator operating pressure also may allow for lower head pressures at the condenser 220, thus allowing for less energy consumption and a longer lifespan for system components.

In addition to higher evaporator pressures, the mass velocity of the refrigerant through the evaporator 240 may be increased by at least partially separating the vapor and liquid portions of the refrigerant before introduction to the evaporator 240 in relation to conventional vapor compression systems that do not at least partially separate the vapor and liquid portions of the refrigerant before introduction to the evaporator 240. This higher mass velocity of the refrigerant in the evaporator 240 may provide enhanced heat transfer efficiency to the surged system 200, as more refrigerant passes through the evaporator 240 in a given time than for a conventional system.

The at least partial separation of the vapor and liquid portions of the refrigerant before introduction to the evaporator 240 also may provide for a temperature decrease in the liquid portion of the refrigerant. Such a decrease may provide more cooling capacity to the liquid portion of the refrigerant in relation to the vapor portion, thus, increasing the total heat transferred by the refrigerant traveling through the evaporator 240. In this manner the same mass of refrigerant traveling through the evaporator 240 may absorb more heat than in a conventional system.

The ability to at least partially separate the vapor and liquid portions of the refrigerant before introduction to the evaporator 240 also may provide for partial as opposed to complete dry-out of the refrigerant at the exit of the evaporator 240. Thus, by tuning the parameters of the vapor and liquid portions of the refrigerant introduced to the evaporator 240, a small liquid portion may remain in the refrigerant exiting the evaporator 240. By maintaining a liquid portion of refrigerant throughout the evaporator 240, the heat transfer efficiency of the system may be improved. Thus, in relation to a conventional system, the same sized evaporator may be able to transfer more heat.

At least partially separating the vapor and liquid portions of the refrigerant before introduction to the evaporator 240 also may result in a refrigerant mass velocity sufficient to coat with liquid refrigerant an interior circumference of the tubing forming the metering device, refrigerant directors, refrigerant transfer system, and/or initial portion of the evaporator 240 following the expansion device. While occurring, the total refrigerant mass within the initial portion of the evaporator 240 is from about 30% to about 95% vapor (mass/mass). If the liquid coating of the circumference is lost, the coating will return when the about 30% to the about 95% vapor/liquid ratio returns. In this way, improved heat transfer efficiency may be provided at the initial portion of the evaporator 240 in relation to conventional systems lacking the liquid coating after the expansion device.

FIG. 3A depicts a side view of a phase separator 300. The separator 300 includes a body portion 301 defining a separator inlet 310, a separator outlet 330, and a refrigerant storage chamber 340. The inlet and outlet may be arranged where angle 320 is from about 40° to about 110°. The longitudinal dimension of the chamber 340 may be parallel to the separator outlet 330; however, other configurations may be used. In FIG. 3B1, a chamber inlet 342 may be substantially parallel to the separator outlet 330 while a longitudinal dimension 343 of the chamber 340 is at an angle 350 to the chamber inlet 342. For the phase separator 300 of FIG. 3B1, the angle 350 may determine the volume of liquid refrigerant that may be held in the chamber 340. FIG. 3B2 is a more detailed representation of the separator 300 of FIG. 3B1, where the separator 300 has been cast into metal 390. The phase separator 300 may have other means for intermittently retaining the liquid refrigerant. Other means may be used to separate at least a portion of the vapor from the liquid of the expanded refrigerant to provide vapor surges to the initial portion of the evaporator.

The chamber 340 has a chamber diameter 345. The separator inlet 310 has a separator inlet diameter 336. The separator outlet 330 has a separator outlet diameter 335. The longitudinal dimension 343 may be from about 4 to 5.5 times the separator outlet diameter 335 and from about 6 to 8.5 times the separator inlet diameter 336. The storage chamber 340 has a volume defined by the longitudinal dimension 343 and the chamber diameter 345. A conventional system capable of providing up to 14,700 kilojoules (kJ) per hour of heat transfer using R-22 refrigerant may provide up to 37,800 kJ per hour of heat transfer when modified with a phase separator having these dimensions and a storage chamber volume from about 49 $cm^3$ to about 58 $cm^3$. The volume of the storage chamber 340 may be determined from the chamber diameter 345 and the longitudinal dimension 343. Other dimensions and volumes may be used with different refrigerants and refrigerant mass flow rates to provide surged systems.

Vapor phase refrigerant surges may be provided to the initial portion of the evaporator by equipping the system with a phase separator having a ratio of the separator inlet diameter to the separator outlet diameter of about 1:1.4 to 4.3 or of about 1:1.4 to 2.1; a ratio of the separator inlet diameter to the separator longitudinal dimension of about 1:7 to 13; and a ratio of the separator inlet diameter to a refrigerant mass flow rate of about 1:1 to 12. While these ratios are expressed in units of centimeters for length and in units of kg/hr for mass flow rate, other ratios may be used including those with other units of length and mass flow rate.

The ratio of the separator inlet diameter to the separator longitudinal dimension may be increased or decreased from these ratios until the system no longer provides the desired surge rate. Thus, by altering the ratio of the separator inlet diameter to the longitudinal dimension, the surge frequency of the system may be altered until it no longer provides the desired defrost effect. Depending on the other variables, these ratios of the separator inlet diameter to the refrigerant mass flow rate may be increased or reduced until surging stops. These ratios of the separator inlet diameter to the refrigerant mass flow rate may be increased or reduced until either surging stops or the desired cooling is no longer provided. A person of ordinary skill in the art may determine other ratios to provide a desired surge or surges, a desired surge frequency, cooling, combinations thereof, and the like.

In relation to the other components of the heat transfer system, the chamber 340 is sized to separate at least a portion of the vapor from the expanded refrigerant entering through the separator inlet 310, intermittently store a portion of the liquid in the chamber 340 while passing substantially refrigerant vapor in the form of at least one vapor surge through the separator outlet 330, and then passing the fluid from the chamber 340 through the separator outlet 330. By altering the construction of the phase separator 300, the number, cycle time, and duration of the vapor surges passed through the separator outlet 330 to the evaporator may be selected. As previously described, the temperature fluctuations in the initial portion of the evaporator are responsive to these surges during operation of the compressor.

Referring to FIGS. 2 and 3B, to implement the surged system 200 as suitable for air-conditioning, the dimensions of the phase separator 231, 300 may be paired with a refrigerant and a refrigerant flow rate to provide a desired cooling capacity at a desired evaporator temperature. For example, the phase separator 300 having an inlet diameter of about 1.3 cm, an outlet diameter of about 1.9 cm, a longitudinal dimension of about 10.2 cm, and a storage chamber volume of about 29 $cm^3$ may be paired with an about 3.1 kg/hr mass flow rate of R-22 refrigerant to provide about 30,450 kJ per hour of heat transfer at an evaporator temperature of about 7° C., as suitable for air-conditioning. By increasing the refrigerant mass flow rate to about 3.8 kg/hr using the same phase separator, the surged system 200 can provide about 37,800 kJ per hour of heat transfer while maintaining the evaporator temperature of about 7° C.

As different refrigerants have different heat transfer capacities, the same phase separator may be used with R-410a refrigerant at a mass flow rate of about 3.0 kg/hr to provide about 30,450 kJ per hour of heat transfer, or at a mass flow rate of about 3.7 kg/hr to provide about 37,800 kJ per hour of heat transfer, while maintaining the evaporator temperature at about 7° C. Thus, by altering the mass flow rate and the heat transfer capacity of the refrigerant passed through the phase separator, 231, 300, the surged system 200 may provide the desired heat transfer at the desired evaporator temperature.

The same phase separator may be used to provide an evaporator temperature of about −6° C., as suitable for refrigeration. Pairing the phase separator with R-404a refrigerant at about 3.7 kg/hr, R-507 refrigerant at about 3.7 kg/hr, or R-502 refrigerant at about 4.0 kg/hr will provide about 25,200 kJ per hour of heat transfer with an evaporator temperature of about −6° C. Similarly, pairing the phase separator with R-404a refrigerant at about 4.6 kg/hr, R-507 refrigerant at about 4.6 kg/hr, or R-502 refrigerant at about 5.0 kg/hr will provide about 31,500 kJ per hour of heat transfer with an evaporator temperature of about −6° C. Thus, after selecting the type of cooling and the heat transfer desired, a person of ordinary skill in the art can select the compressor 210, the condenser 220, the evaporator 240, the refrigerant, the operating pressures, and the like to provide a heat transfer system using a desired phase separator, which inputs surges of refrigerant vapor to the initial portion of the evaporator 240.

If larger heat transfer rates are desired, the capacity of the surged system 200 may be increased by increasing the size of the phase separator 231, 300 and the associated system components. For example, to implement the surged system 200 as suitable to provide between 90,300 and 97,650 kJ of air-conditioning, the phase separator 300 may be selected to have an inlet diameter of about 1.6 cm, an outlet diameter of about 3.2 cm, a longitudinal dimension of about 20.3 cm, and a storage chamber volume of about 161 $cm^3$. This larger phase separator may be paired with an about 9.1 kg/hr mass flow rate of R-22 refrigerant to provide about 90,300 kJ per hour of heat transfer at an evaporator temperature of about 7° C., as suitable for air-conditioning. By increasing the refrigerant mass flow rate to about 9.8 kg/hr using the same phase separator, the surged system 200 may provide about 97,650 kJ per hour of heat transfer while maintaining the evaporator temperature of about 7° C.

As different refrigerants have different heat transfer capacities, the same phase separator may be used with R-410a refrigerant at a mass flow rate of about 8.8 kg/hr to provide about 90,300 kJ per hour of heat transfer, or at a mass flow rate of about 9.5 kg/hr to provide about 97,650 kJ per hour of heat transfer, while maintaining the evaporator temperature at about 7° C. Thus, by altering the mass flow rate and the heat transfer capacity of the refrigerant passed through the phase separator, 231, 300, the surged system 200 may provide the desired heat transfer at the desired evaporator temperature.

The same larger phase separator may be used to provide an evaporator temperature of about −6° C., to provide between 76,650 and 84,000 kJ for refrigeration. Pairing the phase separator with R-404a refrigerant at about 11.2 kg/hr, R-507 refrigerant at about 11.2 kg/hr, or R-502 refrigerant at about 12.2 kg/hr will provide about 76,650 kJ per hour of heat transfer with an evaporator temperature of about −6° C. Similarly, pairing the phase separator with R-404a refrigerant at about 12.3 kg/hr, R-507 refrigerant at about 12.3 kg/hr, or R-502 refrigerant at about 13.4 kg/hr will provide about 84,000 kJ per hour of heat transfer with an evaporator temperature of about −6° C. Thus, after selecting the type of cooling and the Joules of heat desired for transfer, one of ordinary skill in the art can select the phase separator 231, the compressor 210, the condenser 220, the evaporator 240, the refrigerant, the operating pressures, and the like to provide a heat transfer system that inputs surges of refrigerant vapor to the initial portion of the evaporator.

Figure 4:
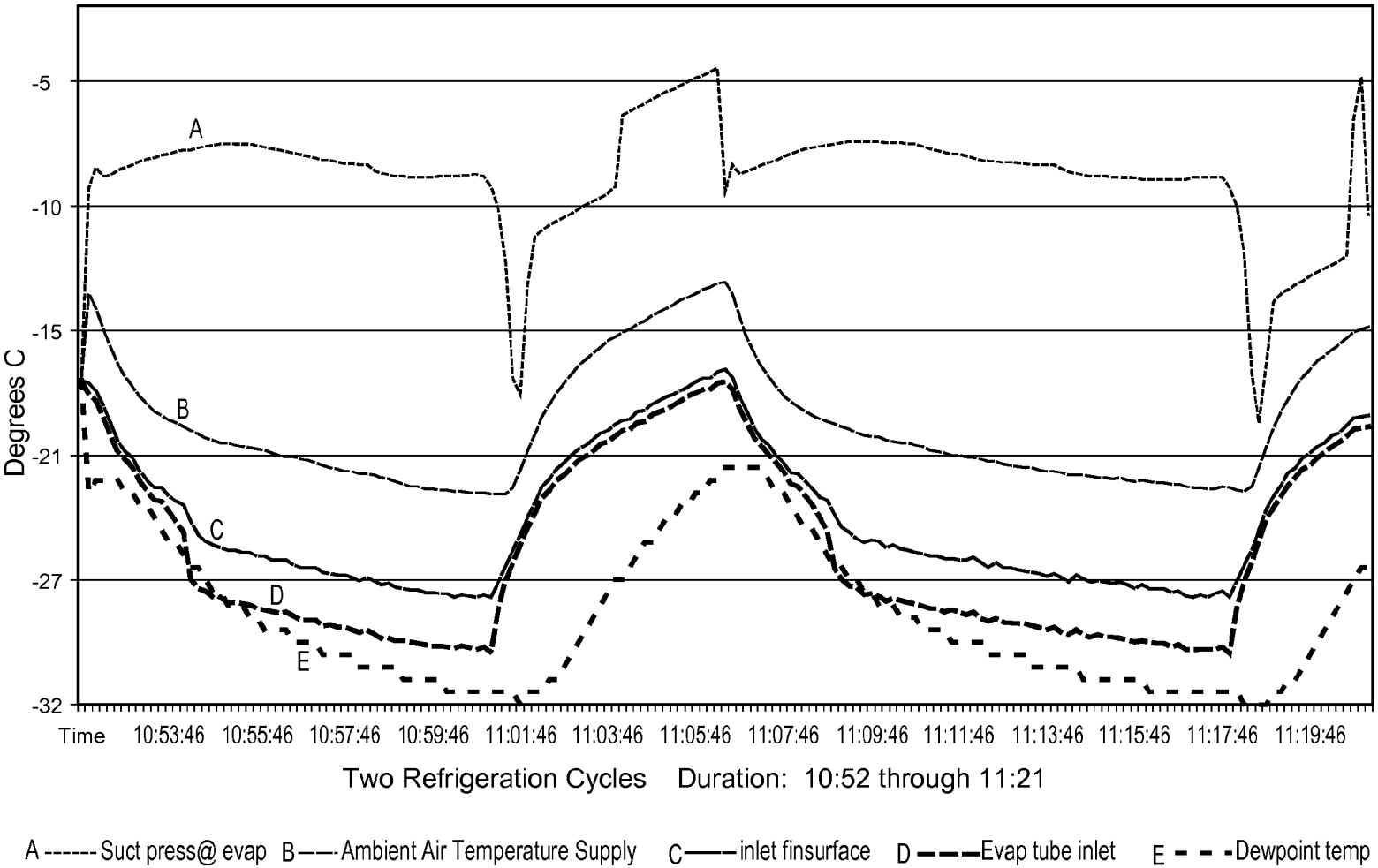
FIG. 4 is a plot showing the temperature verses time for a conventional vapor compression heat transfer system.

FIG. 4 is a plot showing the temperature in degrees Centigrade verses time for a conventional heat transfer system. The temperature and dew point of the air surrounding an evaporator was monitored in addition to the temperature of the fin and tube surfaces of the initial portion of the evaporator. The compressor was turned on at about 11:06 minutes, the highest point in the suction pressure line A. When the compressor started and the evaporator cooled, the temperature dropped relatively rapidly and began to level off at about 11:10 minutes. Once the compressor started, the slope of the fin and tube temperature lines, lines C and D, respectively was always negative. Thus, consecutive temperatures were not larger than previous temperatures until the compressor shuts off at about 11:17 minutes. Furthermore, from about 11:08 to about 11:09 minutes, the temperature of the initial portion of the evaporator tube dropped below that of the dew point of the ambient air, thus allowing for condensation. Thus, the temperature of the initial portion of the evaporator always was significantly lower than the temperature of the air flowing through the evaporator. The same behavior of a negative slope for evaporator temperature and a time period of below dew point operation also may be seen during the prior compressor cycle from about 10:53 to 10:59 minutes. After about five minutes of operation, this system lost a portion of its efficiency due to frost formation and/or lubricating oil puddling at the initial portion of the evaporator.

Figure 5:
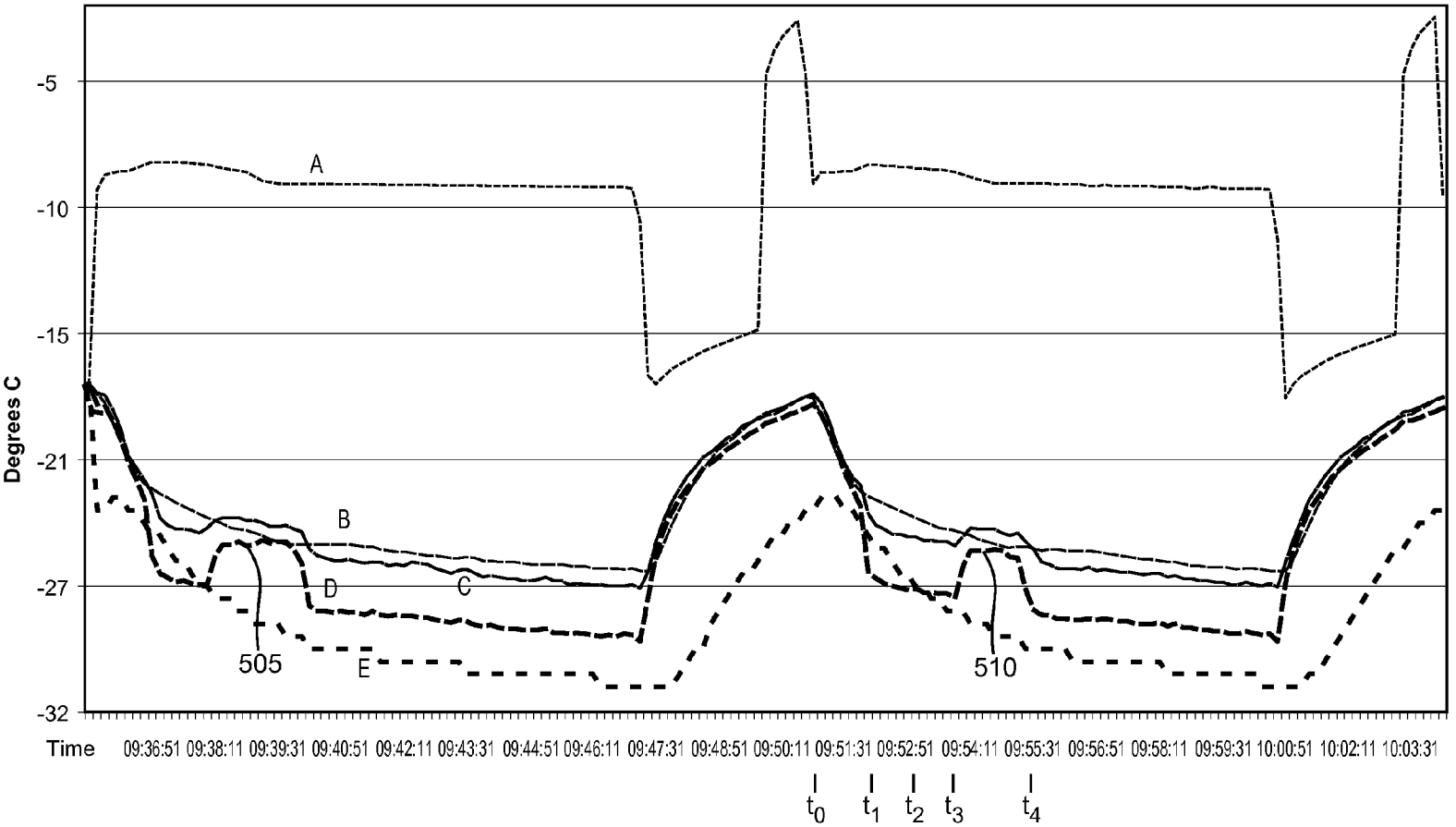
FIG. 5 is a plot illustrating the temperature verses time for a surged vapor compression heat transfer system.

FIG. 5 is a plot showing the temperature in degrees Centigrade verses time for a surged heat transfer system. The surged system is like the conventional system of FIG. 4, except for the insertion of an appropriate phase separator. The temperature and dew point of the air surrounding an evaporator was monitored in addition to the temperature of the fin and tube surfaces of the initial portion of the evaporator. The compressor was turned on at about to, the highest point in the suction pressure line A. When the compressor started and the evaporator cooled, the temperature dropped relatively rapidly during the initial cool down period between $t_0$ and $t_1$, and then began to level off at about $t_1$. Unlike in the conventional system of FIG. 4, where the slope of the fin and tube temperature lines, lines C and D, respectively, are always negative, at $t_3$ in FIG. 5 the temperature of the initial portion of the evaporator rapidly increases, by approximately 3° C. for the tube, forms a plateau, and rapidly falls at $t_4$. While the negative slope of the line D, representing tube temperature, is about the same before and after the increase, intermittent temperature increase 510 is a significant upward departure. Thus, for a surged heat transfer system the temperature profile for the initial portion of the evaporator during operation of the compressor includes portions having both positive and negative slopes. While this system was configured to provide a single temperature increase per compressor operating cycle (as also seen in the prior intermittent increase 505), additional intermittent increases with different frequencies and durations also may be used.

As in the conventional system of FIG. 4, during compressor operation, the surged system of FIG. 5 shows between $t_1$ and $t_2$ where the temperature of the initial portion of the evaporator tube dropped below that of the dew point of the air, thus allowing for condensation. From the time period and temperature (graph area) the tube spent below due point, one skilled in the art may determine the approximate kJ of cooling energy available for the formation of condensation and frost. From the area of the intermittent temperature increase 510, one skilled in the art also may determine that the approximate kJ of heat energy available to remove frost resulting from condensation, in relation to the constant negative slope line D as observed in the conventional system of FIG. 4. In this manner, the initial portion of the evaporator is intermittently warmed without turning off the compressor or actively introducing heat to the evaporator. After about 24 hours of operation, this surged system had lost substantially none of its efficiency, as frost had not formed at the initial portion of the evaporator. While not wishing to be bound by any particular theory, it is believed that this vapor surge heat energy cancels out at least a portion of the cooling energy below the dew point that could produce frost, thus, reducing frost build up.

FIG. 5 also establishes that the surged heat transfer system achieved a colder (by approximately 3° C.) air temperature at the evaporator at the same suction pressure as the conventional system of FIG. 4. Thus, more cooling work was done with the same refrigerant pressure, which provided a more efficient system. The intermittent temperature increase 510 also did not result in a corresponding temperature increase of the supply air flowing across the evaporator (line C). Thus, while the temperature was increasing at the evaporator inlet, the temperature of the air flowing through the evaporator continued to decrease, an unexpected and counterintuitive result.

Figure 6:
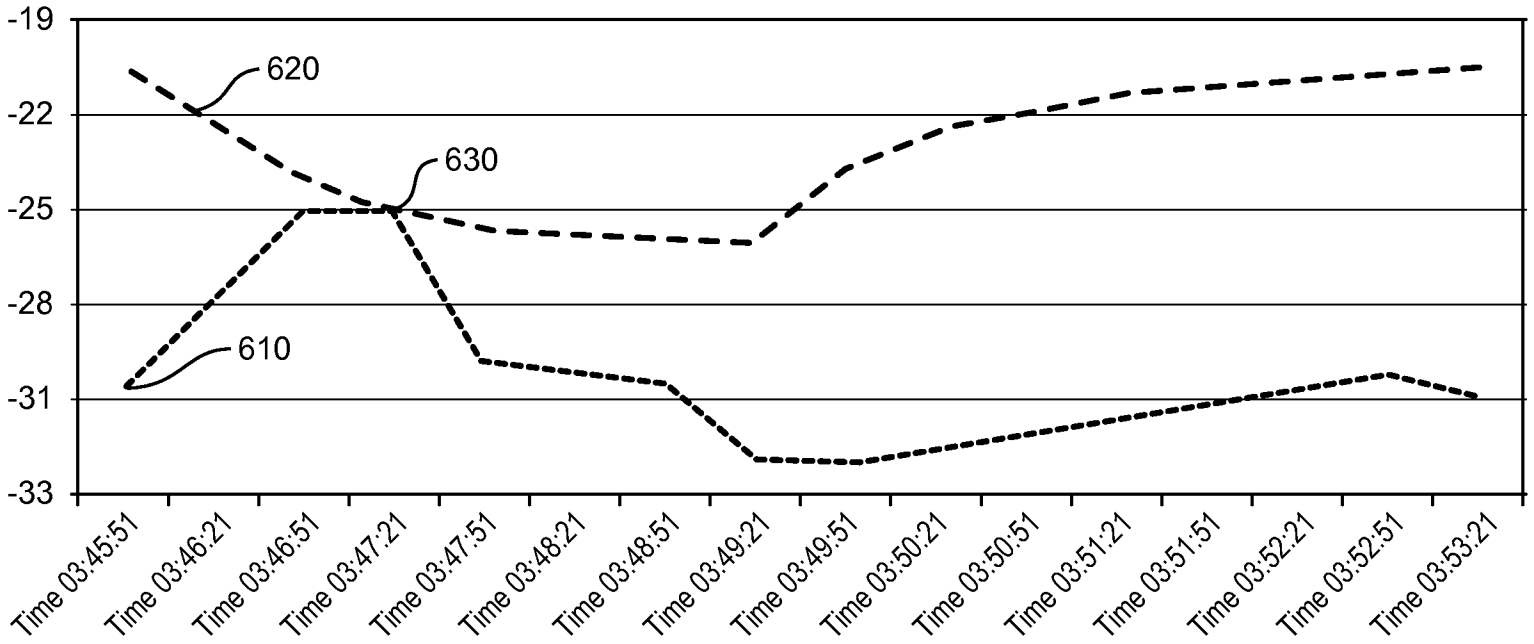
FIG. 6 shows the temperature of the air flowing through the evaporator in relation to the coil temperature at the initial portion of the evaporator in a surged vapor compression heat transfer system.

FIG. 6 also shows the effect of the surged system on the temperature of the air flowing through the evaporator in relation to the coil temperature at the initial portion of the evaporator. As seen in the figure, the temperature of the air flowing through the evaporator reached about −21° C. and the initial portion of the evaporator had fallen to about −31° C. At point 610 where the initial portion of the evaporator began to increase in temperature, the temperature of the air flowing through the evaporator began to drop at 620. As the temperature at the initial portion of the evaporator increased and the temperature of the air flowing through the evaporator decreased, the initial portion of the evaporator reached a temperature point 630 that approached or exceeded the temperature of the air flowing through the evaporator.

If frost forms at the initial portion of the evaporator, the surged heat transfer system is believed to return at least a portion of the water to the air flowing through the evaporator by sublimation. While not wishing to be bound by any particular theory, the relative warming of the initial portion of the evaporator from the surge of vapor phase refrigerant is believed to result in sublimation of the frost from the initial portion of the evaporator, as the temperature of the initial portion of the evaporator remains below freezing during the surge. Thus, if the surged system forms frost at the initial portion of the evaporator at −31° C., and the surge of vapor phase refrigerant causes an intermittent temperature increase to −25° C. at the initial portion of the evaporator, and this increase occurs as the temperature of the air flowing across the evaporator approaches or becomes less than the temperature at the initial portion of the evaporator—frost will sublimate into the air flowing across the evaporator.

More energy is required to cool humid than dry air as some portion of the cooling energy applied to the humid air is consumed to convert gas phase water to a liquid, not to cool the air. Thus, any energy consumed dehumidifying the air can be considered latent work that provides no cooling. However, if frost is sublimated from the initial portion of the evaporator, at least a portion of the latent work stored in the frost is used to cool the initial portion of the evaporator as the frost evaporates. While consuming energy like a conventional closed loop heat transfer system to convert water vapor into liquid water that forms frost on the initial portion of the evaporator during a portion of the cooling cycle when the compressor is running, during introduction of vapor phase refrigerant surges to the evaporator, the surged system is believed to recover at least a portion of this otherwise wasted energy as cooling. This is believed to be true as any effect that provides a colder evaporator with less energy will provide an increase in cooling efficiency.

By returning water vapor to the air flowing across the evaporator during each surge, the surged system may maintain a higher relative humidity (RH) in a conditioned space than a conventional system, while providing more cooling with less energy consumption, as the amount of energy consumed dehumidifying the air during ongoing operation of the surged system is reduced in relation to the identical conventional cooling system lacking a phase separator and surged vapor phase refrigerant introduction to the evaporator. Thus, in addition to reducing the multiple problems associated with evaporator frosting, the surged system may provide the benefits of increased RH in the conditioned space and reduced energy consumption for the same cooling in relation to conventional systems.

Figure 7:
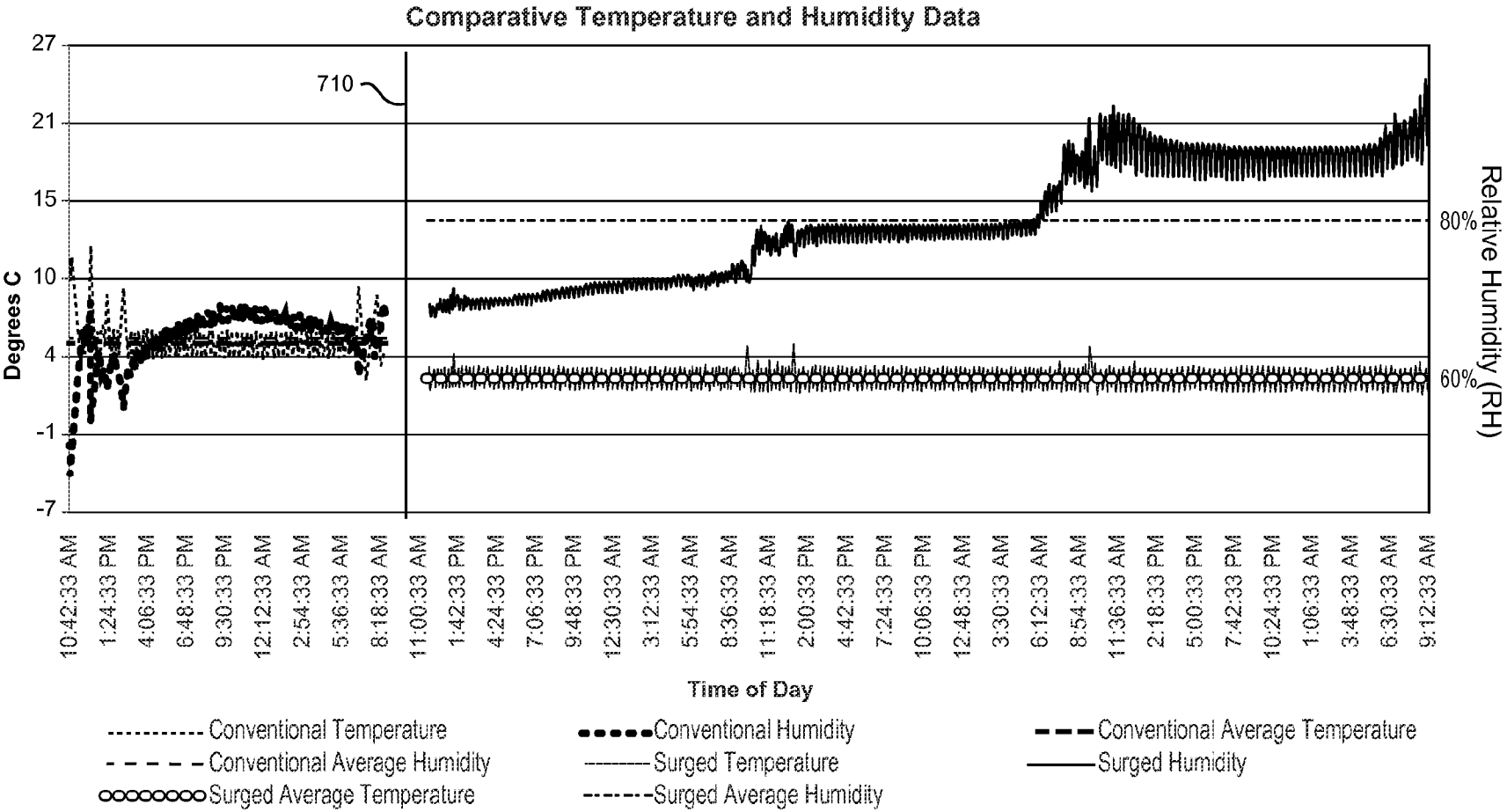
FIG. 7 compares the temperature and humidity performance of a conventional heat transfer system with a surged heat transfer system.

FIG. 7 compares the temperature and humidity performance of a conventional heat transfer system with a surged heat transfer system. The conventional system included a Copeland compressor, model CF04K6E, a model LET 035 evaporator, and a model BHT011L6 condenser. The left side of the graph shows the temperature and RH inside a walk-in storage cooler as maintained by the conventional system. The conventional system maintained the average temperature at about 6° C. and the average RH at about 60% (weight of water/weight of dry air).

A phase separator was then added to this conventional system and the mass flow rate of the refrigerant adjusted to allow surged operation. After 710, the temperature and RH were then monitored inside the walk-in storage cooler as the system was operated to provide surges of vapor phase refrigerant to the inlet portion of the evaporator. During surged operation, the system maintained the average temperature at about 2° C. and the average RH at about 80%. Thus, after modification with a phase separator and operated to provide surges of vapor phase refrigerant to the inlet portion of the evaporator, the other components of the conventional system maintained the interior of the walk-in storage cooler at a significantly lower temperature and at an approximately 30% higher RH. These results were obtained without using active defrost.

Figure 8:
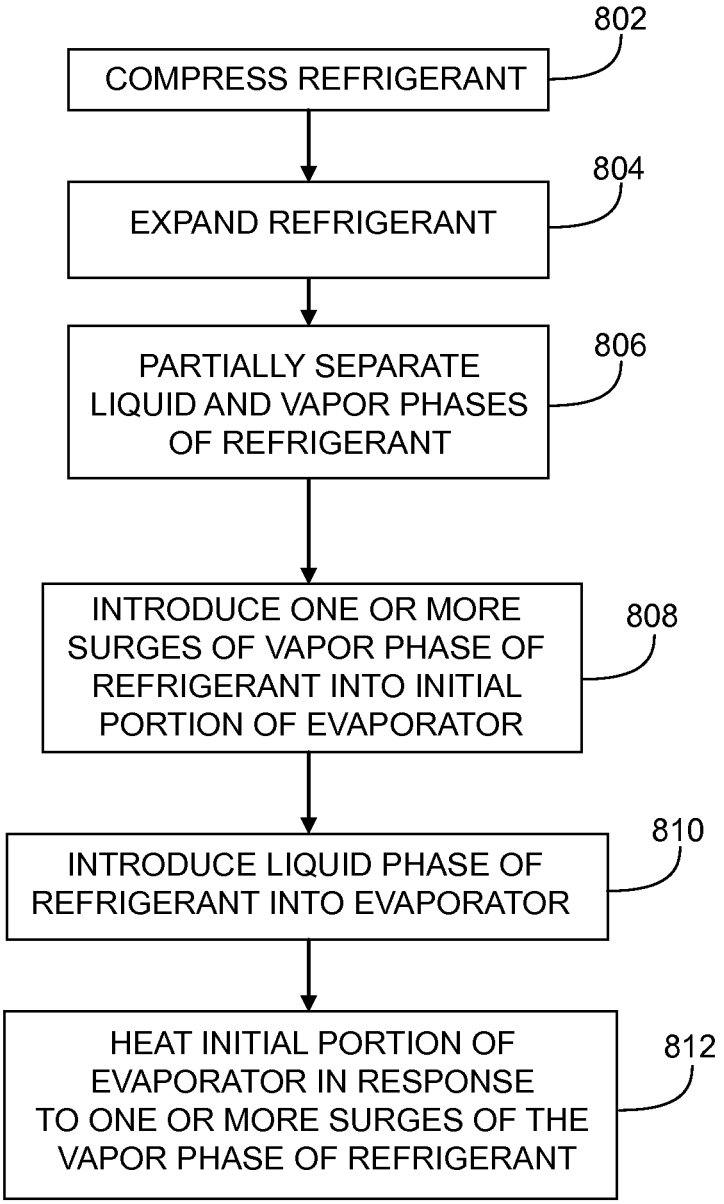
FIG. 8 depicts a flowchart of a method for operating a heat transfer system.

FIG. 8 depicts a flowchart of a method for operating a heat transfer system as previously discussed. In 802, a refrigerant is compressed. In 804, the refrigerant is expanded. In 806, the liquid and vapor phases of the refrigerant are at least partially separated. In 808, one or more surges of the vapor phase of the refrigerant are introduced into the initial portion of an evaporator. The surges of the vapor phase of the refrigerant may include at least 75% vapor. The initial portion of the evaporator may be less than about 10% or less than about 30% of the volume of the evaporator. The initial portion may have other volumes of the evaporator. In 810, the liquid phase of the refrigerant is introduced into the evaporator.

In 812, the initial portion of the evaporator is heated in response to the one or more surges of the vapor phase of the refrigerant. The initial portion of the evaporator may be heated to less than about 5° C. of a temperature of a first external medium. The initial portion of the evaporator may be heated to a temperature greater than a first external medium. The initial portion of the evaporator may be heated to a temperature greater than a dew point temperature of a first external medium. The temperature difference between the inlet and outlet volumes of the evaporator may be from about 0° C. to about 3° C. The heat transfer system may be operated where a slope of the temperature of the initial portion of the evaporator includes negative and positive values. The initial portion of the evaporator may sublimate or melt frost. The frost may sublimate when the temperature of the initial portion of the evaporator is equal to or less than about 0° C.

Figure 9:
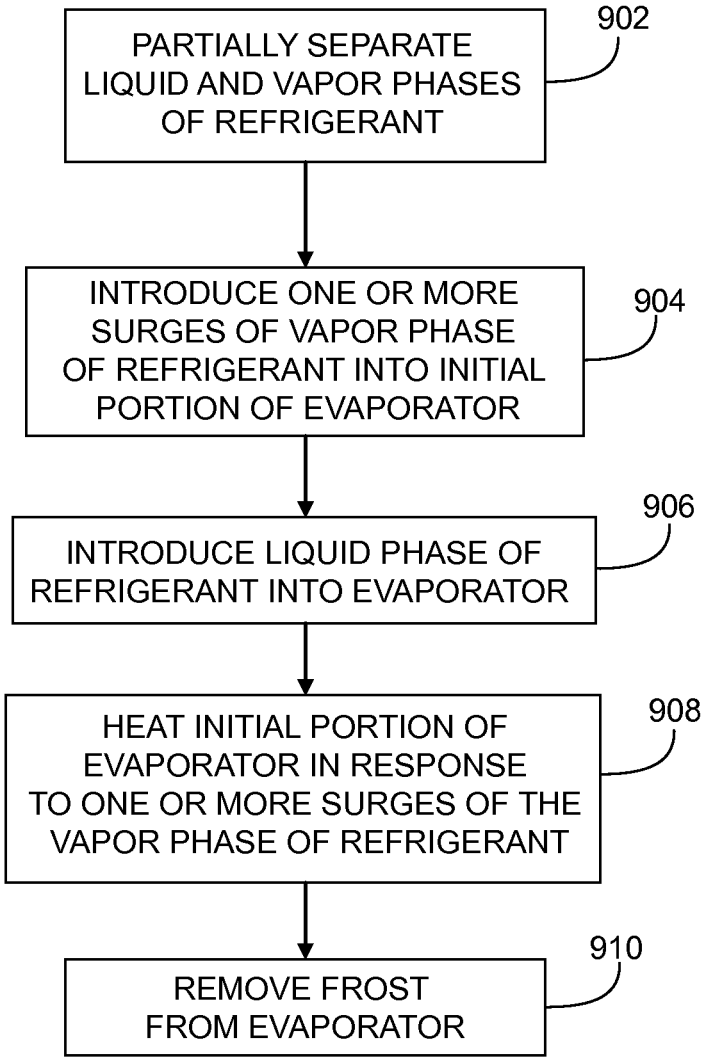
FIG. 9 depicts a flowchart of a method for defrosting an evaporator in a heat transfer system.

FIG. 9 depicts a flowchart of a method for defrosting an evaporator in a heat transfer system as previously discussed. In 902, the liquid and vapor phases of the refrigerant are at least partially separated. In 904, one or more surges of the vapor phase of the refrigerant are introduced into the initial portion of an evaporator. The surges of the vapor phase of the refrigerant may include at least 75% vapor. The initial portion of the evaporator may be less than about 10% or less than about 30% of the volume of the evaporator. The initial portion may have other volumes of the evaporator. In 906, the liquid phase of the refrigerant is introduced into the evaporator.

In 908, the initial portion of the evaporator is heated in response to the one or more surges of the vapor phase of the refrigerant. The initial portion of the evaporator may be heated to less than about 5° C. of a temperature of a first external medium. The initial portion of the evaporator may be heated to a temperature greater than a first external medium. The initial portion of the evaporator may be heated to a temperature greater than a dew point temperature of a first external medium. The temperature difference between the inlet and outlet volumes of the evaporator may be from about 0° C. to about 3° C. The heat transfer system may be operated where a slope of the temperature of the initial portion of the evaporator includes negative and positive values.

In 910, frost is removed from the evaporator. Remove includes substantially preventing the formation of frost. Remove includes essentially removing the presence of frost from the evaporator. Remove includes the partial or complete elimination of frost from the evaporator. The initial portion of the evaporator may sublimate or melt the frost. The frost may sublimate when the temperature of the initial portion of the evaporator is equal to or less than about 0° C.

Example 1

Blast-Freezer Room

A Delta Heat Transfer condensing unit was used with two thirty horsepower Bitzer semi-hermetic reciprocating compressors (2L-40.2Y) to provide expanded refrigerant to a standard high-velocity Heathcraft commercial evaporator (model BHE 2120) to cool a blast-freezer room using R404a refrigerant. The system was operated by cooling the blast-freezer room from 0° C. to below −12° C. and maintaining the room below −12° C. for the time necessary to solidly freeze hot bakery product. The air supplied by the evaporator to the blast-freezer room was between −34° C. and −29° C. when the compressors were operating. Six, active defrost cycles of the evaporator with electric heating elements were required daily. After the addition of a phase separator and operating the system to provide surges of vapor phase refrigerant to the inlet portion of the evaporator, the need for active defrost cycles were eliminated. Additionally, a product quality improvement was experienced in the form of a 1% (weight/weight) retention in product weight in relation to the conventional system operated with the six active defrost cycles per day.

Example 2

Commercial Food Service Retail

An ICS condensing unit (model PWH007H22DX) was used with an approximately three-quarter horsepower Copeland hermetic compressor to provide expanded refrigerant to a standard ICS commercial evaporator (model AA18-66BD) to cool a cold-storage room at a commercial food service retail facility using R22a refrigerant. The system was operated where the temperature of the cold-storage room remained below 2° C. for seven days. The air supplied by the evaporator to the cold-storage room was between −7° C. and 0° C. when the compressor was operating. Four, active defrost cycles of the evaporator with electric heating elements were required daily. After the addition of a phase separator and operating the system to provide surges of vapor phase refrigerant to the inlet portion of the evaporator, the need for active defrost cycles were eliminated. Additionally, a product quality improvement was experienced in the form of an improvement in the color and the texture of the surface of fresh meat.

Example 3

Freezer Room for Meat Storage

A Russell condensing unit (model DC8L44) was used with a 2.5 horsepower Bitzer semi-hermetic reciprocating compressor (model 2FC22YIS14P) to provide expanded refrigerant to a standard Russell commercial evaporator (model ULL2-361) to cool a freezer cold-storage room using R404a refrigerant. The system was operated to maintain the temperature of the freezer cold-storage room below −12° C. for ten days. The air supplied by the evaporator to the cold-storage room was between −18° C. and −20° C. when the compressor was operating. Four, active defrost cycles of the evaporator with electric heating elements were required daily at 6 hour intervals. After the addition of a phase separator and operating the system to provide surges of vapor phase refrigerant to the inlet portion of the evaporator, the need for active defrost cycles were eliminated.

While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. A method of operating a heat transfer system during a cooling cycle, comprising:

compressing a refrigerant;

expanding the refrigerant;

at least partially separating liquid and vapor phases of the refrigerant;

introducing at least one surge of the vapor phase of the refrigerant into an initial portion of an evaporator with an expanded refrigerant transfer system, where the initial portion of the evaporator is a volume of the evaporator;

introducing the liquid phase of the refrigerant into the initial portion of the evaporator with the expanded refrigerant transfer system; and heating the initial portion of the evaporator in response to the at least one surge of the vapor phase of the refrigerant.

2. The method of claim 1, further comprising heating the initial portion of the evaporator to within at most about 5° C. of a temperature of a first external medium.

3. The method of claim 1, further comprising heating the initial portion of the evaporator to a temperature greater than a first external medium.

4. The method of claim 1, further comprising heating the initial portion of the evaporator to a temperature greater than a dew point temperature of a first external medium.

5. The method of claim 1, where a temperature difference between an inlet portion of the evaporator and an outlet portion of the evaporator is from about 0° C. to about 3° C.

6. The method of claim 1, further comprising operating the system where a slope of the temperature of the initial portion of the evaporator includes negative and positive values.

7. The method of claim 1, further comprising removing frost from the initial portion of the evaporator.

8. The method of claim 1, further comprising sublimating frost from the initial portion of the evaporator, where the temperature of the initial portion of the evaporator is at most about 0° C.

9. The method of claim 1, where the initial portion of the evaporator is less than about 30% of the volume of the evaporator.

10. The method of claim 1, where the initial portion of the evaporator is less than about 10% of the volume of the evaporator.

11. The method of claim 1, where the initial portion of the evaporator has at least one intermittent temperature maximum, and where the at least one intermittent temperature maximum is responsive to the at least one surge of the vapor phase of the refrigerant, and where the intermittent temperature maximum is within at most about 5° C. of a temperature of a first external medium.

12. The method of claim 11, where the at least one intermittent temperature maximum is greater than the temperature of the first external medium.

13. The method of claim 11, where the at least one intermittent temperature maximum is greater than a dew point temperature of the first external medium.

14. The method of claim 11, where a temperature difference between the initial 10% of the volume of the evaporator and the last 10% of the volume of the evaporator is from about 0° C. to about 3° C.

15. The method of claim 11, where the relative humidity of the first external medium is greater than the relative humidity of the first external medium when surges of the vapor phase refrigerant are not introduced to the initial portion of the evaporator.

16. The method of claim 11, where the temperature of the first external medium is lower than the temperature of the first external medium when surges of the vapor phase refrigerant are not introduced to the initial portion of the evaporator and an active defrost cycle is not used.

17. The method of claim 11, further comprising operating the system where a slope of the temperature of the initial portion of the evaporator includes negative and positive values.

18. The method of claim 11, further comprising removing frost from the initial portion of the evaporator in response to the intermittent temperature maximum.

19. The method of claim 11, further comprising sublimating frost from the initial portion of the evaporator in response to the intermittent temperature maximum, where the temperature of the initial portion of the evaporator is at most about 0° C.

20. The method of claim 11, where the initial portion of the evaporator is less than about 30% of the volume of the evaporator.

21. The method of claim 11, where the initial portion of the evaporator is less than about 10% of the volume of the evaporator.

22. The method of claim 1, where the at least one surge of the vapor phase of the refrigerant includes at least 75% vapor.

23. The method of claim 1, where the average heat transfer coefficient from the initial portion to an outlet portion of the evaporator is from about 1.9 $Kcal_{th}\ h^{-1}\ m^{-2}\ ^{\circ}C.^{-1}$ to about 4.4 $Kcal_{th}\ h^{-1}\ m^{-2}\ ^{\circ}C.^{-1}$ and where the initial portion of the evaporator is less than about 10% of the volume of the evaporator, and where the outlet portion of the evaporator is less than about 10% of the volume of the evaporator.

24. A method of defrosting an evaporator in a heat transfer system during a cooling cycle, comprising:

at least partially separating liquid and vapor phases of a refrigerant;

introducing at least one surge of the vapor phase of the refrigerant into an initial portion of an evaporator with an expanded refrigerant transfer system, where the initial portion of the evaporator is a volume of the evaporator;

introducing the liquid phase of the refrigerant into the initial portion of the evaporator with the expanded refrigerant transfer system;

heating the initial portion of the evaporator in response to the at least one surge of the vapor phase of the refrigerant; and removing frost from the evaporator.

25. A heat transfer system, comprising:

a compressor having an inlet and an outlet;

a condenser having an inlet and an outlet;

an evaporator having an inlet, an initial portion having a first volume, a later portion having a second volume, and an outlet, the outlet of the compressor in fluid communication with the inlet of the condenser, the outlet of the condenser in fluid communication with the inlet of the evaporator, and the outlet of the evaporator in fluid communication with the inlet of the compressor;

a metering device in fluid communication with the condenser and the evaporator, where the metering device expands a refrigerant, the refrigerant having vapor and liquid portions; and a phase separator in fluid communication with the metering device and the evaporator, where the phase separator is capable of separating a portion of the vapor from the expanded refrigerant, and where the phase separator is capable of introducing during a cooling cycle at least one surge of the vapor to the initial portion of the evaporator between operating periods of introducing the expanded refrigerant into the initial portion of the evaporator that include a substantially increased liquid component in relation to the at least one surge of the vapor.

26. The method of claim 1, where the at least partial separation of the liquid and vapor phases of the refrigerant causes a net cooling of the liquid phase of the refrigerant and a net heating of the vapor phase of the refrigerant.

27. The method of claim 24, where the at least partial separation of the liquid and vapor phases of the refrigerant causes a net cooling of the liquid phase of the refrigerant and a net heating of the vapor phase of the refrigerant.

28. The heat transfer system of claim 25, where the phase separator is capable of raising the temperature of the vapor portion of the refrigerant while lowering the temperature of the liquid portion of the refrigerant.

29. The method of claim 24, further comprising heating the initial portion of the evaporator to within at most about 5° C. of a temperature of a first external medium.

30. The method of claim 24, further comprising heating the initial portion of the evaporator to a temperature greater than a first external medium.

31. The method of claim 24, further comprising heating the initial portion of the evaporator to a temperature greater than a dew point temperature of a first external medium.

32. The method of claim 24, where a temperature difference between an inlet volume of the evaporator and an outlet volume of the evaporator is from about 0° C. to about 3° C.

33. The method of claim 24, where a slope of the temperature of the initial portion of the evaporator includes negative and positive values.

34. The method of claim 24, further comprising sublimating frost from the initial portion of the evaporator.

35. The method of claim 24, further comprising sublimating frost from the initial portion of the evaporator, where the temperature of the initial portion of the evaporator is at most about 0° C.

36. The method of claim 24, where the initial portion of the evaporator is less than about 30% of the volume of the evaporator.

37. The method of claim 24, where the initial portion of the evaporator is less than about 10% of the volume of the evaporator.

38. The method of claim 24, where the at least one surge includes at least 75% vapor.

39. The heat transfer system of claim 25, where the phase separator has a body portion defining a separator inlet, a separator outlet, and a separator refrigerant storage chamber;

where the separator refrigerant storage chamber has a longitudinal dimension;

where a ratio of a diameter of the separator inlet to a diameter of the separator outlet is about 1:1.4 to 4.3 or about 1:1.4 to 2.1; and where a ratio of the diameter of the separator inlet to the longitudinal dimension is about 1:7 to 13.

40. The heat transfer system of claim 39, where a ratio of the diameter of the separator inlet to a refrigerant mass flow rate is about 1:1 to 12.

41. The heat transfer system of claim 25, where the at least one surge removes frost from the initial portion of the evaporator.

42. The heat transfer system of claim 25, where the at least one surge sublimates frost from the initial portion of the evaporator, where the temperature of the initial portion of the evaporator is at most about 0° C.

43. The heat transfer system of claim 25, where the phase separator is capable of introducing at least two surges of the vapor to the initial portion of the evaporator during an operation cycle of the compressor.

44. The heat transfer system of claim 25, where the initial portion of the evaporator is at most 30% of the total volume of the evaporator.

45. The heat transfer system of claim 25, where the initial portion of the evaporator is at most 10% of the total volume of the evaporator.

46. The heat transfer system of claim 25, where the at least one vapor surge introduced to the initial portion of the evaporator raises the initial portion of the evaporator to at least one intermittent temperature maximum within at most 5° C. of a temperature of a first external medium.

47. The heat transfer system of claim 25, where the at least one vapor surge introduced to the initial portion of the evaporator raises the initial portion of the evaporator to at least one intermittent temperature maximum greater than the temperature of a first external medium.

48. The heat transfer system of claim 25, where the at least one vapor surge introduced to the initial portion of the evaporator raises the initial portion of the evaporator to at least one intermittent temperature maximum greater than the dew point temperature of a first external medium.

49. The heat transfer system of claim 25, where the temperature difference between the initial 10% of the total volume of the evaporator and the last 10% of the total volume of the evaporator is from 0° C. to 3° C.

50. The heat transfer system of claim 25, where the at least one surge includes at least 75% vapor.

* * * * *